US011124927B1

(12) United States Patent
Sykes et al.

(10) Patent No.: US 11,124,927 B1
(45) Date of Patent: Sep. 21, 2021

(54) OVERFLOW SPOUT FOR TANK

(71) Applicant: CROM, LLC, Gainesville, FL (US)

(72) Inventors: Elmont Donald Sykes, Island Grove, FL (US); Talmadge B. Mincey, Gainesville, FL (US)

(73) Assignee: CROM, LLC, Gainesville, FL (US)

( * ) Notice: Subject to any disclaimer, the term of this patent is extended or adjusted under 35 U.S.C. 154(b) by 0 days.

(21) Appl. No.: 17/180,894

(22) Filed: Feb. 22, 2021

Related U.S. Application Data

(60) Provisional application No. 63/010,709, filed on Apr. 16, 2020.

(51) Int. Cl.
*E01C 11/22* (2006.01)
*E04H 7/20* (2006.01)

(52) U.S. Cl.
CPC ..... *E01C 11/223* (2013.01); *E04H 7/20* (2013.01)

(58) Field of Classification Search
CPC .... E01C 11/223; E01C 11/224; E01C 11/227; E04H 7/20; E04H 7/02
See application file for complete search history.

(56) References Cited

U.S. PATENT DOCUMENTS 2,417,190 A * 3/1947 Crom ..... E04H 7/20 52/196
2,531,742 A * 11/1950 Pomykala ..... F17C 3/005 52/249
3,301,041 A * 1/1967 Mueller ..... G21C 13/093 73/35.17
4,843,778 A 7/1989 Puder
5,129,413 A 7/1992 Puder et al.
5,150,551 A 9/1992 Crom et al.
5,237,793 A 8/1993 Puder
6,227,758 B1 * 5/2001 Missick ..... E01C 11/223 210/164
7,111,751 B2 9/2006 Copley et al.
8,684,220 B2 4/2014 Harvey
9,187,309 B1 * 11/2015 Krechowiecki ..... B67D 7/3209
9,316,445 B2 4/2016 Mincey
9,618,277 B2 4/2017 Mincey
10,400,441 B1 9/2019 Bevis
2005/0210795 A1 9/2005 Gunness et al.
2011/0203192 A1 * 8/2011 Schneider ..... E02D 29/124 52/20
2011/0278211 A1 * 11/2011 Flood, Jr. ..... E03F 5/046 210/170.03
2014/0367328 A1 * 12/2014 Allard ..... E03F 1/002 210/602

(Continued)

*Primary Examiner* — Abigail A Risic
(74) *Attorney, Agent, or Firm* — Saliwanchik, Lloyd & Eisenschenk

(57) ABSTRACT

A modular overflow spout that covers a tank outlet comprising an overflow cover removably attached to a curb assembly. The overflow cover includes a canopy and a cover plate. The curb assembly comprises an outer curb having a lower curb flange that can be incorporated into the tank outlet and an upper curb flange that is positioned above the tank outlet. An inner curb is attached to the outer curb and can be incorporated into the tank outlet with the inner curb. The modularity allows the outer curb to be adjustable within the outlet so that the angle of the upper curb flange is conducive for attachment of the cover plate on the overflow cover after the curb assembly is incorporated into the tank roof.

15 Claims, 19 Drawing Sheets

(56) References Cited

U.S. PATENT DOCUMENTS

| | | | | |
|---|---|---|---|---|
| 2016/0060818 | A1* | 3/2016 | Campbell | E01C 11/223<br>138/109 |
| 2016/0081284 | A1* | 3/2016 | Bowie | A01G 29/00<br>47/48.5 |

* cited by examiner

PLAN

FRONT ELEVATION

NOTES:
*1. FIELD VERIFY DIMENSIONS AND CUT CURB TO PROPER HEIGHT TO PLACE WEIR EDGE AT 3" ABOVE TOW EL. AND TO ENSURE FACE OF OVERFLOW COVER IS PLUMB.

PLAN

FRONT ELEVATION

PLAN

PERSPECTIVE
NTS

OVERFLOW SPOUT FOR TANK

CROSS-REFERENCE TO RELATED APPLICATION

This application claims the benefit of U.S. Provisional Application Ser. No. 63/010,709, filed Apr. 16, 2020, the disclosure of which is hereby incorporated by reference in its entirety, including all figures, tables and amino acid or nucleic acid sequences.

BACKGROUND OF INVENTION

Pre-stressed concrete industrial tanks have been in use for decades. They are often used to store many types of materials and liquids. For example, they have been shown to be efficacious as mill water treatment tanks, reservoirs, water tanks, chemical processing basins, pulp storage chests, and effluent tanks. The strength of these types of tanks have allowed for increased size and capacity.

Enclosed large tanks are vented to protect against build-up of pressure or vacuum under the roof due to gas or liquid flow within the tank. It is not uncommon for debris and other material to find ingress through the vents and cause blockages in the overflow valves. It is also not uncommon for overflow valves to malfunction. For this reason overflow spouts are typically installed on industrial tanks to allow the liquids and other material therein to exit the tank if it becomes overfull. Overflow spouts are often installed at the upper edge of the tank dome and are one of the last components installed on a tank.

Overflow spouts are usually concrete and are incorporated into the material of the tank along the upper edge of the tank dome or roof. These can be heavy and, if damaged, can be difficult to repair or replace. There is a need for an improved overflow spout that is easier to install and, if necessary, to repair or replace without extensive reconstruction.

BRIEF SUMMARY

In accordance with the invention, the problems associated with installing an overflow spout on large concrete pre-stressed tanks is solved by a modular overflow spout that can be installed in stages on a tank. The overflow spout includes an overflow cover that can be joined with a curb assembly. An overflow spout of the subject invention can be manufactured from concrete or similar materials, but can also be manufactured from other materials, which can be less heavy than concrete. Advantageously, the overflow cover can be removed from the curb assembly for repair or replacement without disturbing the curb assembly or the structure of the tank roof.

The curb assembly can include an inner curb having one or more walls that can be joined to an outer curb that has an upper curb flange and a lower curb flange. The outer curb can be positioned within the tank outlet so that the lower curb flange can be cast, integrated, attached, consolidated, or otherwise incorporated with the tank roof or dome. The upper curb flange is located above the tank outlet and can be operably connected to the overflow cover. The angle of the outer curb can be adjusted during incorporation with the tank outlet to accommodate roofs with different pitches. The overflow cover can be attached to or seated on the curb assembly, specifically to the upper curb flange. Advantageously, the ability to adjust the angle and height of the curb assembly, relative to a spring line of the tank, can ensure that the overflow cover is at the proper orientation when joined to the curb assembly. The incorporation of at least the lower curb flange into the roof also provides the advantage of later installing the inner curb and overflow cover onto the adjusted outer curb. Alternatively, the inner curb can be attached to and installed simultaneously with the outer curb. The modularity of the overflow spout also allows for removing and replacing at least the overflow cover without reconstruction of the tank or tank outlet.

It should be noted that this Brief Summary is provided to generally introduce the reader to one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIGS. 1B and 1C illustrate this embodiment of the overflow spout installed on a tank. FIG. 1D shows an alternative embodiment of a partial rim on a cover plate.

FIG. 2F illustrates alternative embodiments of an upper curb flange and a lower curb flange.

FIG. 7A shows the curb assembly in place prior to being incorporated with the roof material. FIG. 7B shows the curb assembly after incorporation with the roof material, with the upper curb flange above the roof top.

DETAILED DISCLOSURE

Figure 1A:
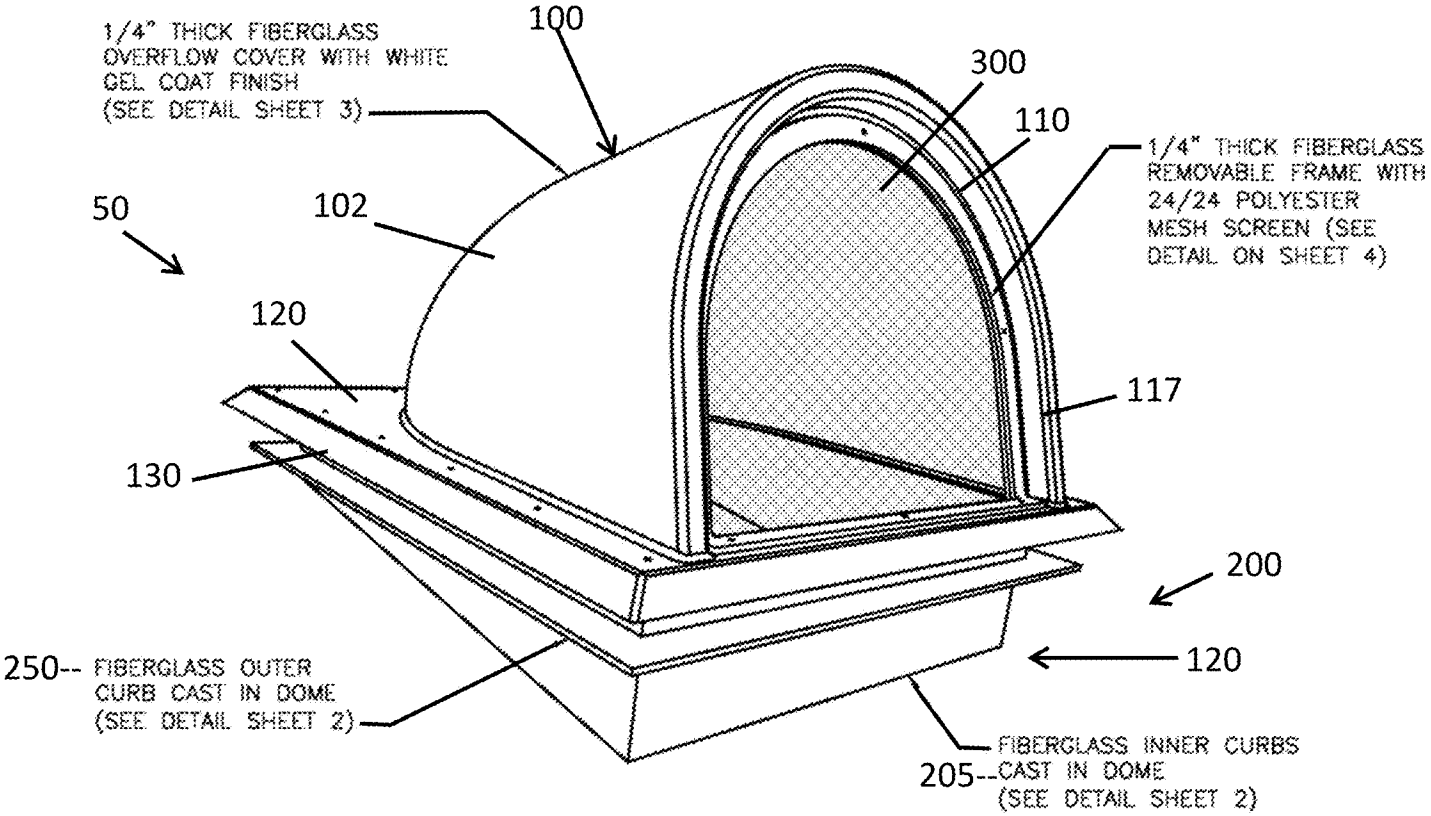
FIGS. 1A, 1B, 1C, and 1D illustrate one embodiment of an overflow spout, according to the subject invention. The overflow cover and curb assembly are shown attached in FIG. 1A.

Embodiments of the subject invention pertain to overflow spouts on tanks used for storing liquids and other materials. More specifically, the subject invention provides one or more embodiments of a modular overflow spout, or similar device, comprising components that can be installed separately or in stages as part of a tank outlet. The components can be adjoined, interlocked, and removably attached.

The following description will disclose that the subject invention is particularly useful in the field of municipal tanks, in particular municipal tanks with a concrete roof. A person with skill in the art will, however, be able to recognize numerous other uses that would be applicable to the devices and methods of the subject invention. While the subject application describes, and many of the terms herein relate to, a use for covering overflow outlets in tanks, other uses and modifications apparent to a person with skill in the art and having benefit of the subject disclosure are contemplated to be within the scope of the present invention.

In the description that follows, a number of terms used in the field of tank design are utilized. In order to provide a clear and consistent understanding of the specification and claims, including the scope to be given such terms, the following definitions are provided.

As used herein, the term "weir edge" refers to the edge of an overflow spout above which fluid will overflow. On a fluid filled tank, the weir edge is the edge to which the fluid can rise and overflow.

As used herein, the term "spring line" refers to the point at which the roof meets the walls of a tank.

As used herein, the terms "about," "substantially," or "approximately" refer to the complete or nearly complete extent or degree of an action, characteristic, property, state, structure, item, or result. For example, an object that is "substantially" in a given position including but not limited to vertical, horizontal, above, below, or adjacent to or aligned with another object, would mean that the object is either completely in that position or nearly completely in that position. The exact allowable degree of deviation from absolute completeness may in some cases depend on the specific context. However, generally speaking the nearness of completion will be so as to have the same overall result as if absolute and total completion were obtained. Thus, it should be understood that absolute accuracy is not required with respect to those aspects for the invention to operate.

Also, as used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

It is to be understood that the Figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

As used herein, terms indicating relative direction or orientation, including but not limited to "upper", "lower", "top", "bottom", "vertical", "horizontal", "outer", "inner", "front", "back", and the like, are intended to facilitate description of the present invention by indicating relative orientation or direction in usual use, and are not intended to limit the scope of the present invention in any way to such orientations or directions.

Reference will be made to the attached Figures on which the same reference numerals are used throughout to indicate the same or similar components. With reference to the attached Figures, which show certain embodiments of the subject invention, it can be seen in the Figures that embodiments of a modular overflow spout 50 of the subject invention comprise an overflow cover 100 that engages with a curb assembly 200. The overflow cover can have a canopy 102 with a tank-side opening 105 and an exterior opening 110 with a conduit 108 there between to accommodate overflow through a tank outlet 25 in the tank 20 roof. There can be a full or partial cover plate 120 around the tank side opening at or near the bottom end of the overflow cover. The curb assembly 200 can have an inner curb 205 and an outer curb 250. The inner curb can comprise one or more walls 206 with a top end and a bottom end. The outer curb can be incorporated with the tank outlet 25 and provide a structure to which the inner curb can be attached to form an overflow channel 210 through the curb assembly inside the tank outlet 25. The angle or orientation of one or more components of the curb assembly can be adjusted relative to each other and/or to a spring line on the tank, so that the overflow cover is at the correct orientation when placed thereon. When an overflow spout is installed on a tank roof 20, overflow from the tank moves through the tank outlet, through the overflow channel and the conduit, continuous therewith, to exit the exterior opening. Thus, the overflow spout provides a path for overflow to move through the tank outlet to the exterior opening. In certain embodiments, the inner curb and outer curb when installed on a tank roof define the tank outlet and tank side opening. Each of these general components can have one or more sub-components, which will be discussed in detail below.

Figure 1B:
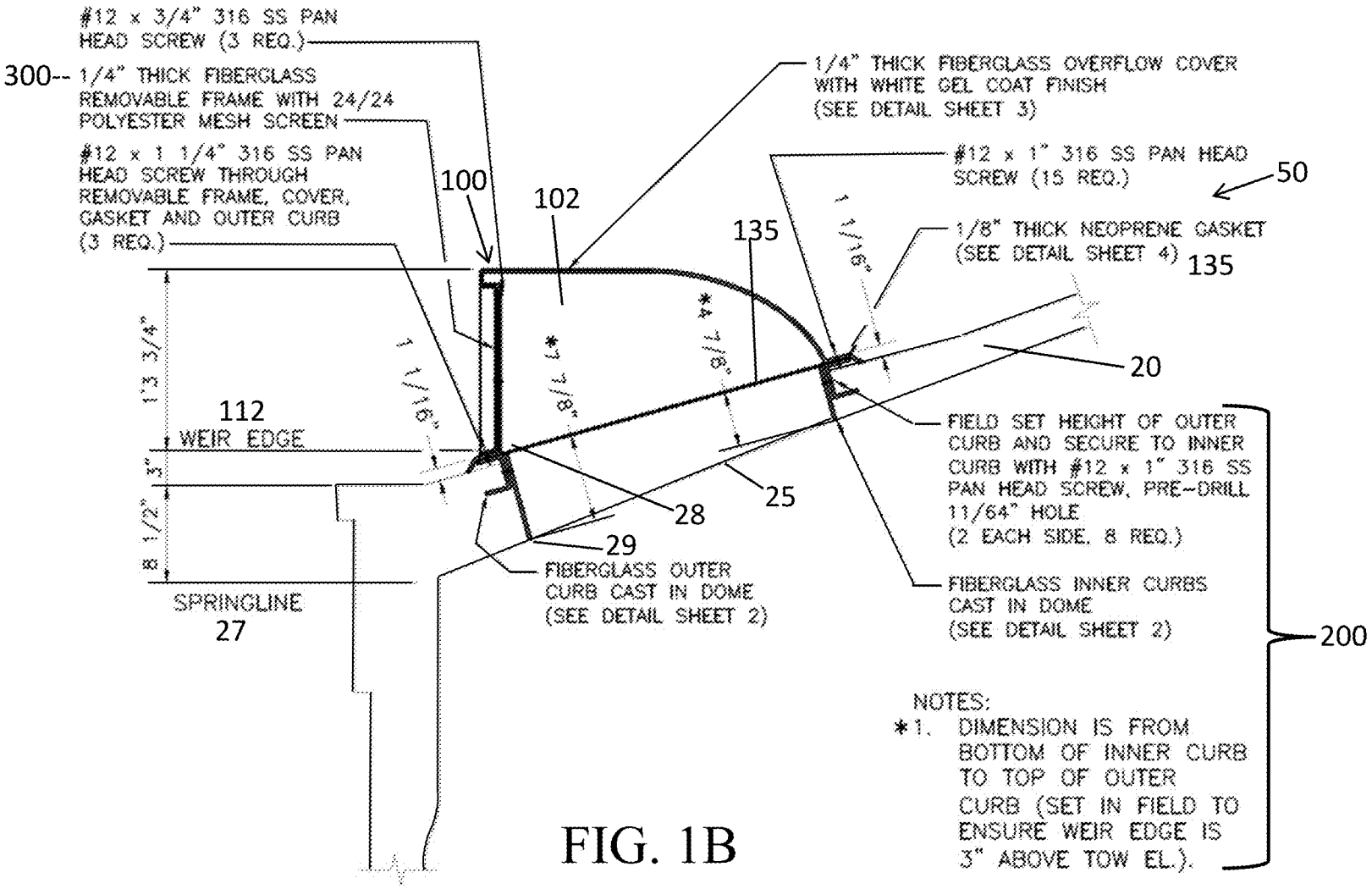
Figure 1C:
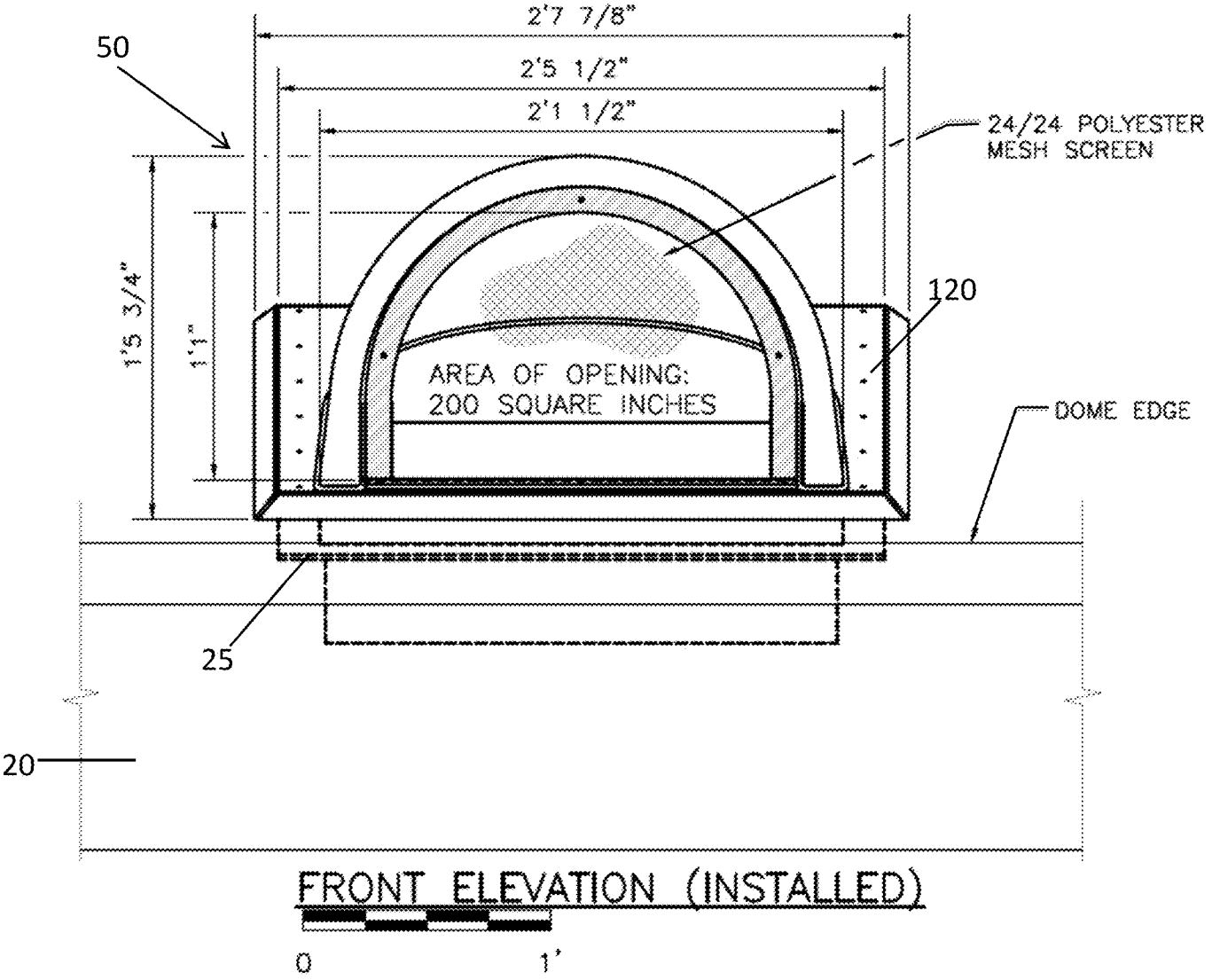
Figure 5A:
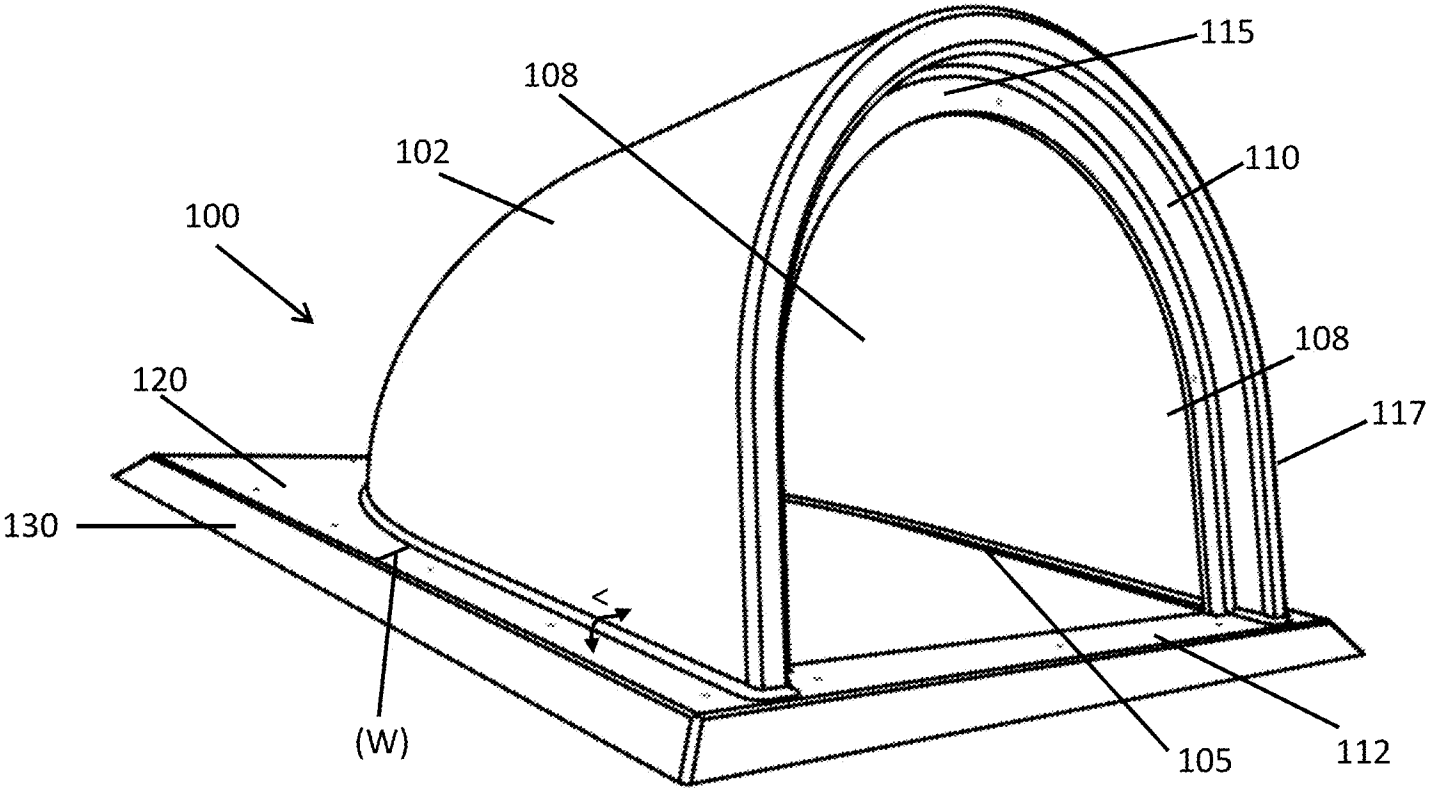
FIGS. 5A, 5B, 5C, and 5D illustrate embodiments of an overflow cover, according to the subject invention.
Figure 5B:
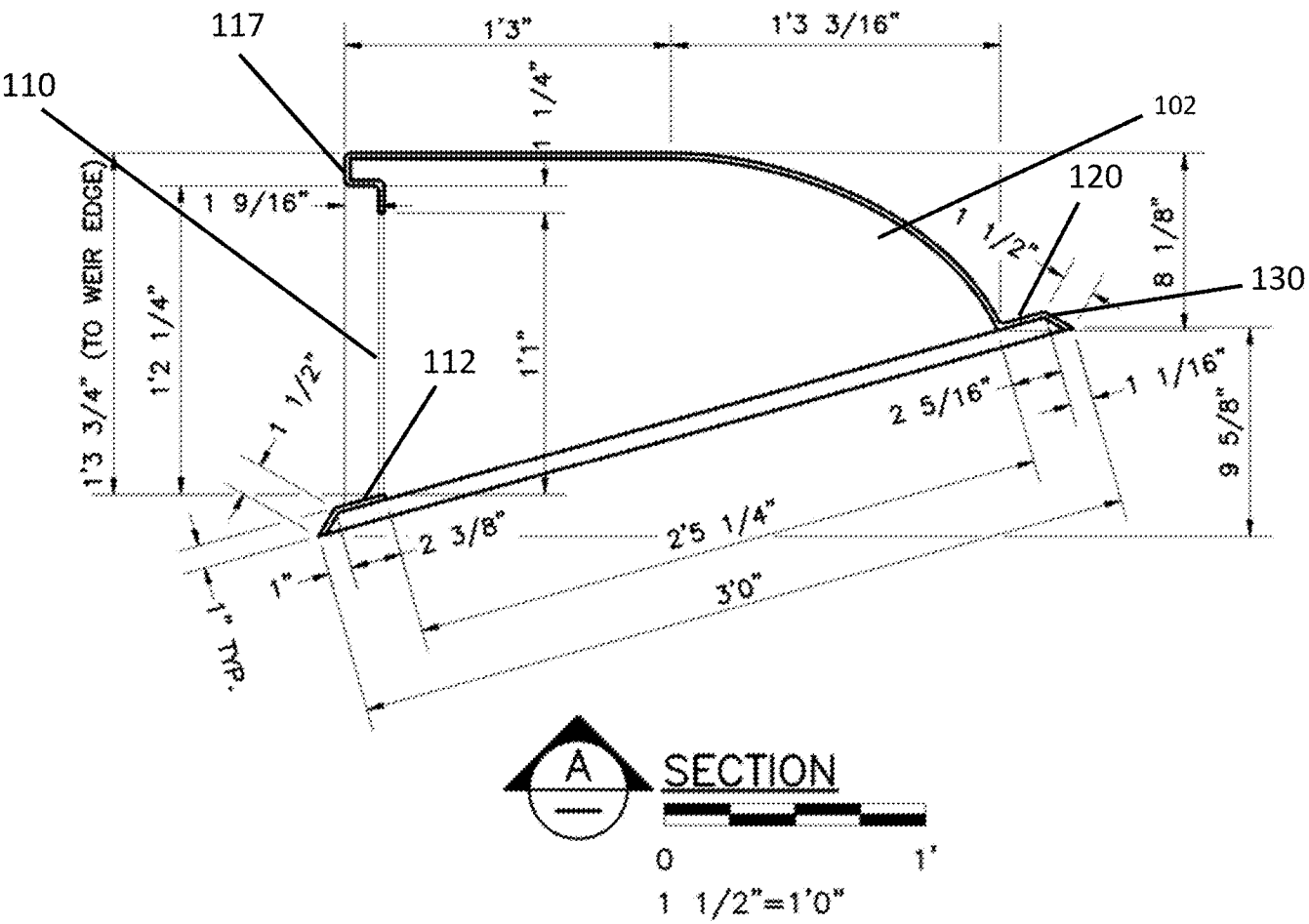
Figure 5C:
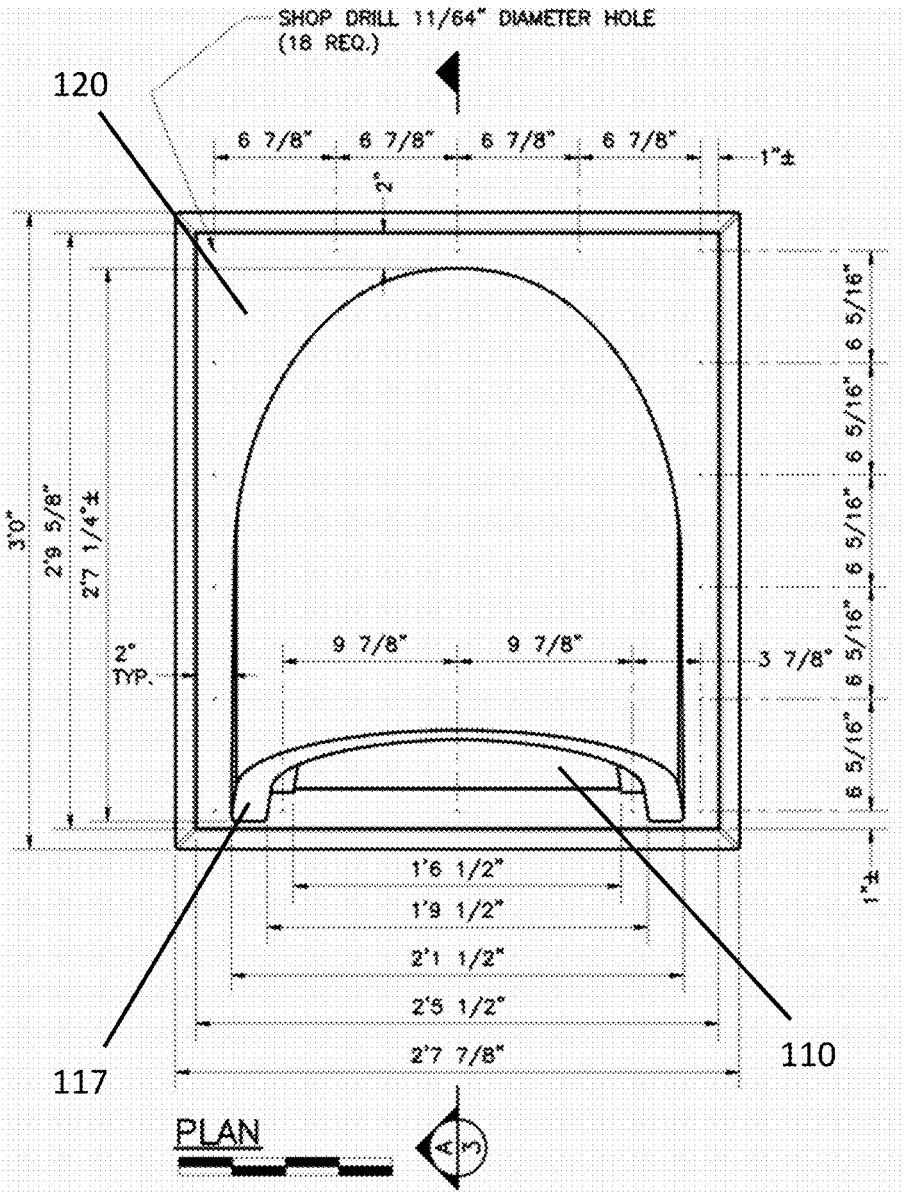
Figure 5D:
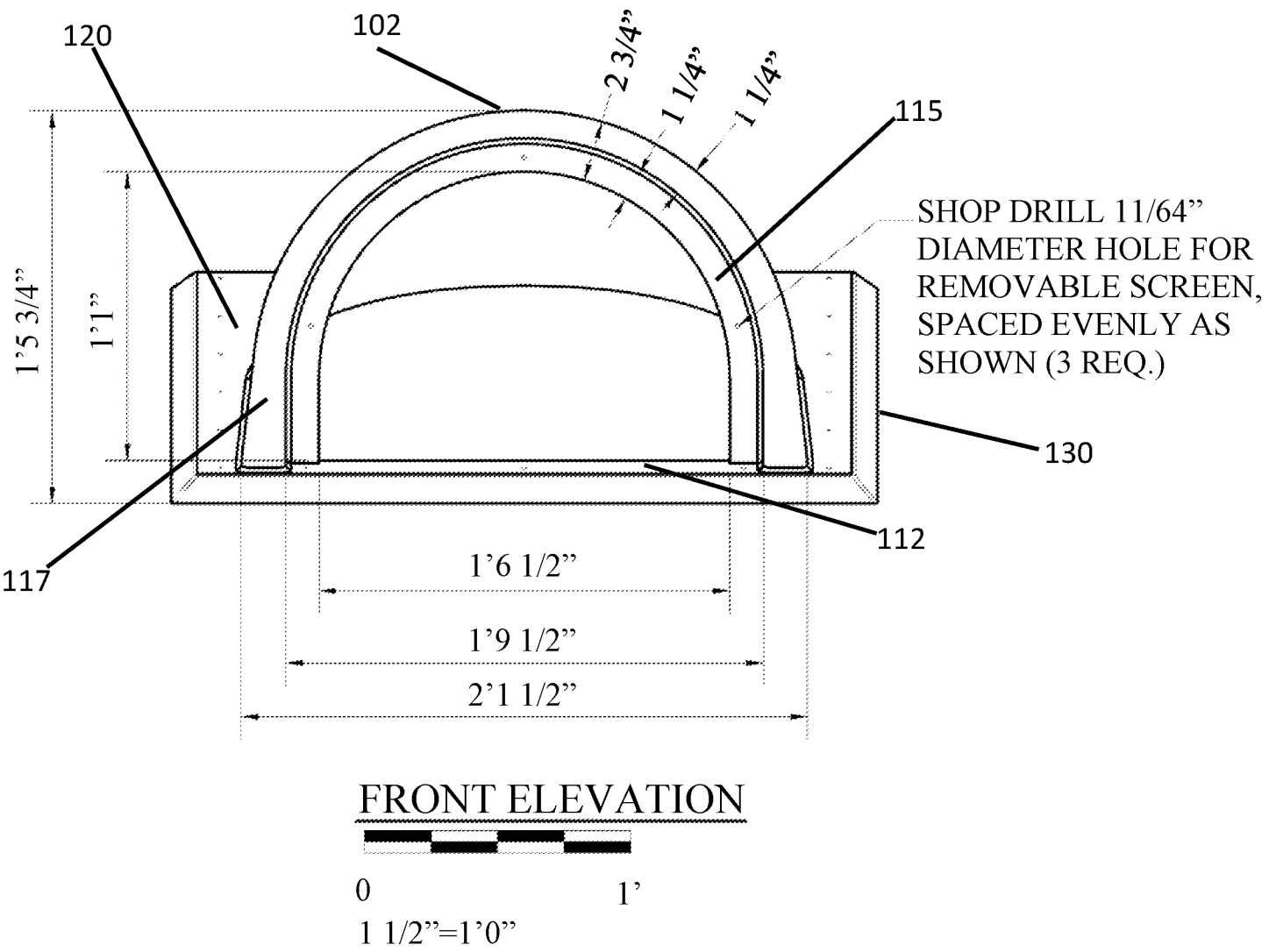
Figure 6B:
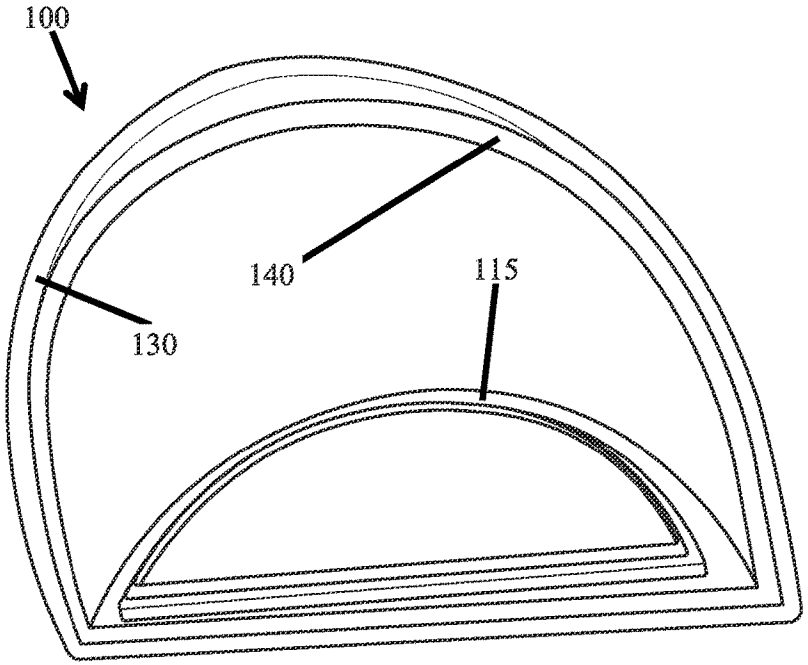
FIGS. 6A, 6B, and 6C are photographs of an alternative embodiment of an overflow cover, according to the subject invention.
Figure 6A:
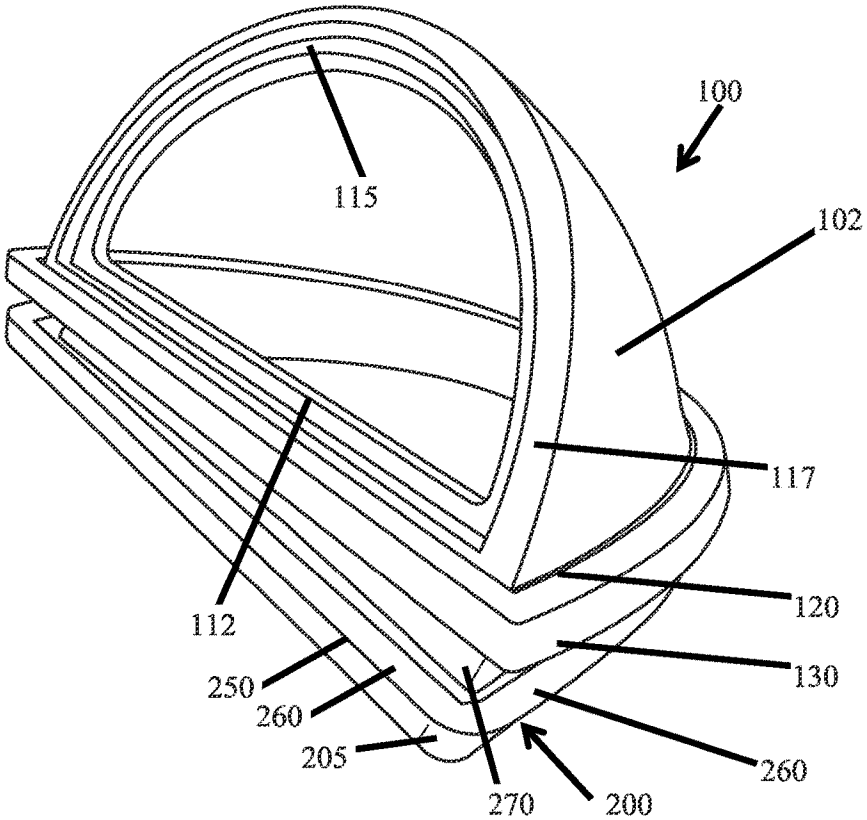
Figure 6C:
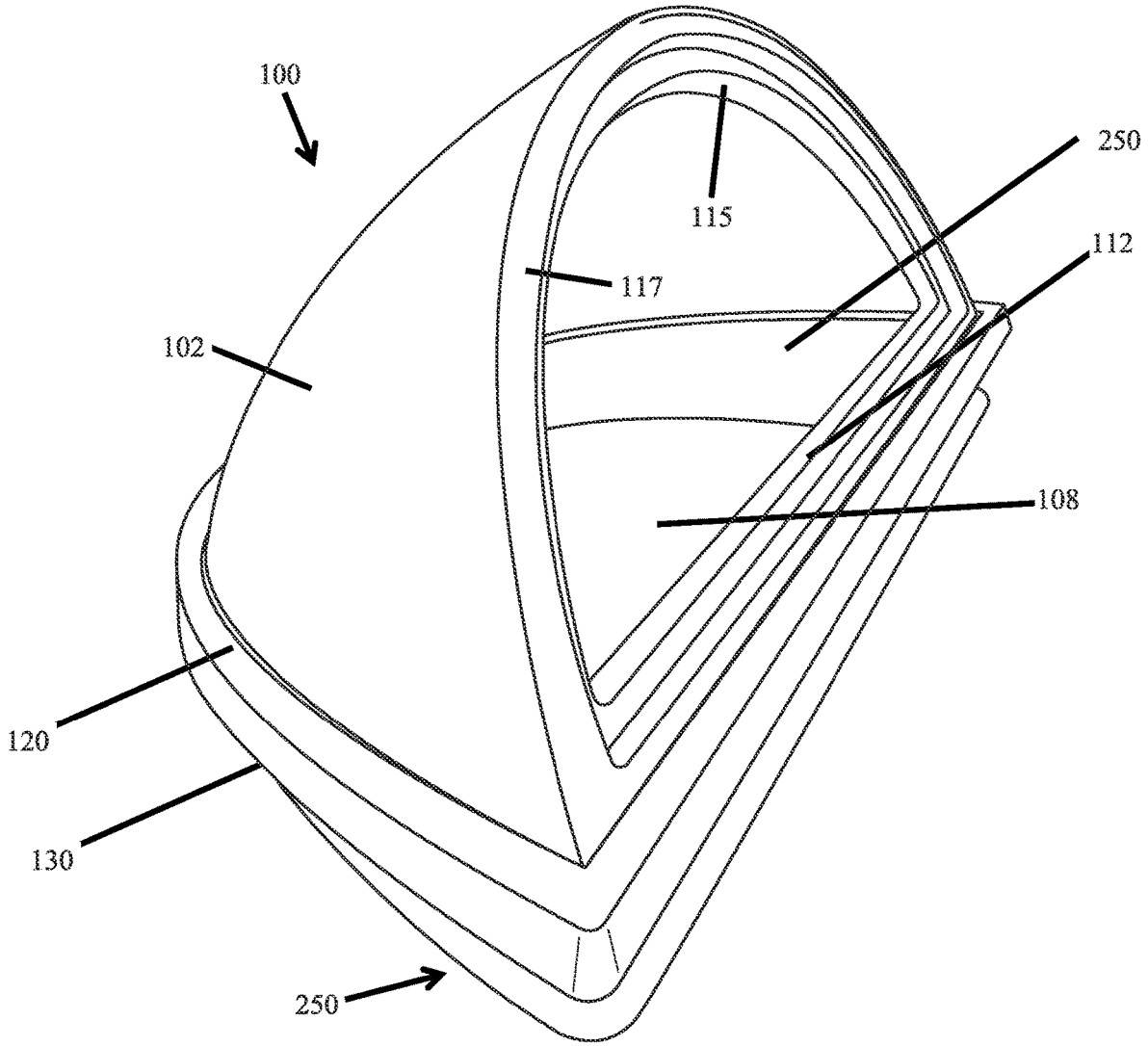

FIGS. 1A, 1B, and 1C illustrate one embodiment of a modular overflow spout 50. FIGS. 5A, 5B, 5C and 5D illustrate one embodiment of an overflow cover 100 that can be utilized with a modular overflow spout 50. The overflow cover can inhibit debris, animals, insects, and other material from falling into the tank through the tank outlet 25. In one embodiment, the overflow cover has a canopy 102 with a tank-side opening 105 that is continuous with the tank outlet. In other words, liquid or other material in the tank can move through the tank outlet, towards and through the tank-side opening. In a further embodiment, the canopy has an exterior opening 110 that directs overflow from the tank. When installed on a tank, the exterior opening can be directed towards the side or spring line 27 of the tank, shown in FIG. 1B, so that overflow from the tank is directed out or away from the roof of the tank. In one embodiment, the exterior opening has a bottom edge that forms a weir 112 as part of the overflow cover, such as shown in FIGS. 5A, 5B, and 5D. When a tank overflows, the liquid and/or other material rises towards the roof until the material height or fluid line exceeds the height of the tank outlet weir edge 28. In one embodiment, the outlet cover weir edge 112 is at or about the same height as the tank outlet weir edge, an example of which is shown in FIG. 1B. In an alternative embodiment, the exterior opening does not have a bottom edge, such that the overflow cover does not have weir. With this embodiment, the material or liquid in the tank will overflow the weir edge of the tank outlet and the canopy can direct it to the edge of the tank or the spring line.

A canopy can have any suitable external configuration that can cover the tank outlet and permit the release of overflow from the tank. FIGS. 1A, 1B, 1C and 1D illustrate one embodiment of a curved, clamshell-style canopy. This does not preclude the canopy having other shapes that may be more functional or appealing on a particular tank. It is within the skill of a person trained in the art and having benefit of the subject disclosure to determine an appropriate outward shape for a canopy. Variations in the canopy shape that provide the same functionality, in substantially the way as described herein, with substantially the same desired results, are within the scope of this invention.

The overflow cover 100 can be affixed to a curb assembly 200, such that the upper opening 208 in the curb assembly aligns with or is otherwise continuous with an overflow channel 210 in the curb assembly that is further open to or in fluid communication with the tank-side opening 105 of the canopy and the tank outlet. This continuity allows fluid or other material in the tank to flow from the tank outlet 25, through the curb assembly, towards the tank-side opening 105, through the conduit 108 in the canopy and out of the exterior opening 110.

In one embodiment, the bottom of the canopy 102 of the overflow cover 100 is affixed to the curb assembly 200. In an alternative embodiment, the overflow cover 100 includes a cover plate 120. The cover plate can be attached at or about the bottom of the canopy. In one specific embodiment, the cover plate is attached around at least a portion of the bottom of the canopy, as shown, for example in FIGS. 1A, and 5A. The cover plate can extend away or radiate from the canopy 102 of the overflow cover. In one embodiment, the cover plate extends away or radiates from the bottom of the canopy of the overflow cover at an angle 75 relative to the canopy, as shown in FIG. 5A, of at least 90°, 95°, 100°, 105°, 110°, 115°, 120°, 125°, 130°, 135°, 140°, 145°, 150°, 155°, 160°, 165°, 170°, 175° or at an angle in a range between any two of the listed values. The angle of the cover can inhibit debris, rain, and other material from collecting around the canopy.

In a further embodiment, the cover plate 120 is operably connected to an upper curb flange 255 of the outer curb 250, to form a joint 135 there between. In a still further embodiment, the cover plate and upper curb flange 255 are substantially coplanar, which can facilitate their attachment. In yet a further embodiment, the cover plate, or some portion thereof, extends or radiates from the bottom of the canopy a sufficient distance to facilitate attachment to the upper curb flange 255. Thus, the width (W) of the cover plate, or some portion thereof, can be different from the width (W) of the upper curb flange. In an alternative embodiment, the width (W) of the cover plate is approximately equal to the width (W) of the upper curb flange. An example of this is shown in FIG. 1B, where the cover plate is shown seated on the upper curb flange. The Figures show an embodiment where the cover plate has a peripheral shape that is rectangular. The peripheral shape of a cover plate is, however, not limited to a rectangle and can have any peripheral shape that can be seated on and attached to an upper curb flange. Thus, for example, a cover plate can have a peripheral shape that is circular, ovate, square, triangular, diamond, any other polygonal shape, or some combination thereof.

While the cover plate 120 and the upper curb flange 255 can be seated directly on top of or adjacent to one another, it can be beneficial to utilize a gasket 140 in the joint 135 formed between them to improve seating, inhibit friction, and mitigate leakage. It can be beneficial for a gasket to be weather-resistant. In one embodiment, a gasket is one or more viscous, liquid, moldable, or otherwise, non-solid substance or material applied to one or both surfaces. The substance or material can harden, cure, solidify or otherwise form a gasket between the surfaces. In another embodiment, a gasket is a preformed or pre-molded solid, semi-solid, or pliable device positioned between the upper outer curb and the cover plate. A non-limiting example would be a neoprene or similar type of preformed gasket that can be placed in one or more sections between the upper curb flange and the cover plate. Some combination of a pre-formed gasket and a substance or material that forms a gasket can also be utilized. FIGS. 1B, 3, 6B and 7A illustrate examples of gaskets on the cover plate for positioning against the upper curb flange.

Figure 1D:
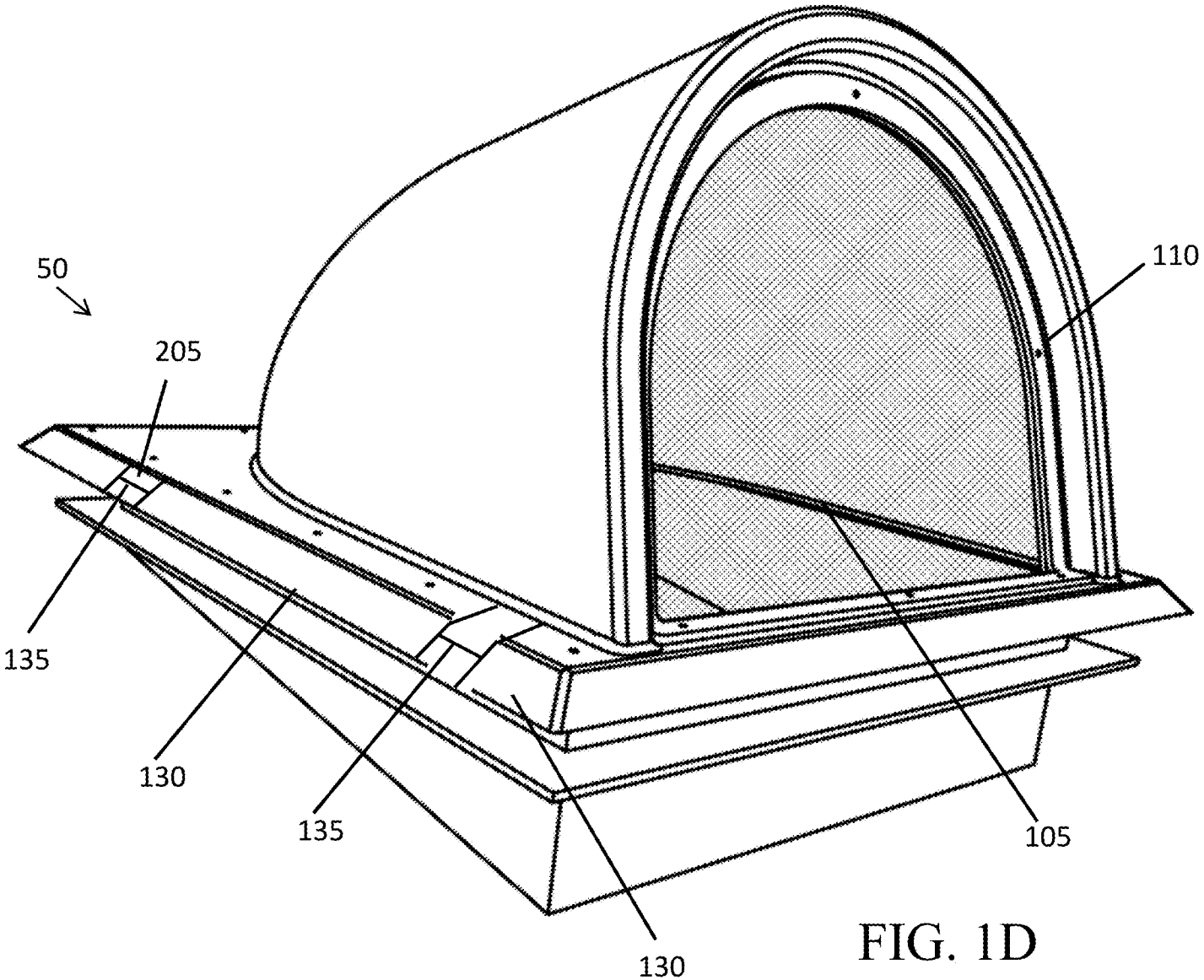

To facilitate seating of the cover plate 120 on the upper curb flange 250, there can be a full or partial rim 130 on the cover plate. The rim can be directed towards the tank outlet or the curb assembly 200 or away from the canopy. When seating an overflow cover with a cover plate onto a curb assembly with an upper curb flange thereon, the rim can assist in guiding and/or aligning the cover plate so that it seats or fits onto on the curb frame with the cover plate properly aligned over the upper curb flange. The rim can also cover and provide some protection to the joint 135 and, if present, a gasket 140 within the joint 135. In one embodiment, the cover upper curb flange and/or the top of the inner curb are surrounded or entirely covered under the rim. One example of this is shown in FIG. 1A. In an alternative embodiment, the rim is non-continuous, such that the top of the curb frame and/or the upper curb flange thereon are not fully surrounded or are partially covered under the rim. One example of this is shown in FIG. 1D.

Figure 2A:
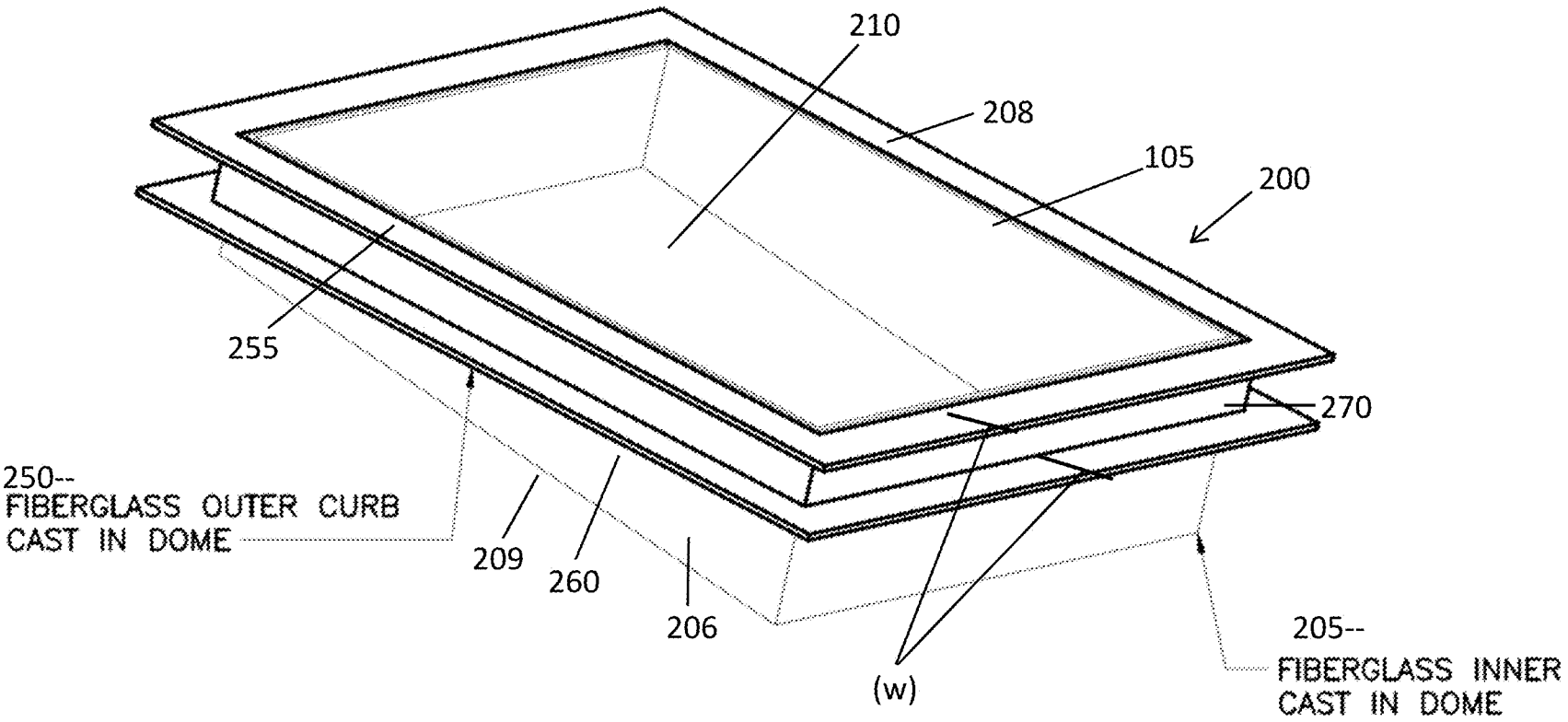
FIGS. 2A, 2B, 2C, 2D, 2E, and 2F illustrate embodiments of a curb assembly, according to the subject invention.

The overflow cover 200 can also be supported on the curb assembly 200. The curb assembly can have an inner curb 205 that can be attached within the outer curb 250. The outer curb can have at least one wall brace 270 with a lower curb flange 260 at least partially surrounding the outside of the wall brace at or near the bottom opening 209 and the upper curb flange 255 at least partially surrounding the wall brace at or near the upper opening 208. The wall brace can have the upper opening 208 and the bottom opening 209 joined by an overflow channel 210 there between. The upper curb flange and the lower curb flange can extend out or radiate from the wall brace. In one embodiment, the width (W) of the upper curb flange and the lower curb flange is the same, such as shown, for example, in FIGS. 2A and 2E. In an alternative embodiment, the upper curb flange and the lower curb flange have different widths (W), such as shown for example, in FIG. 2F, left side. In one embodiment, the upper curb flange and the lower curb flange are coplanar, such that they extend from the wall brace at the substantially the same angle, such as shown, for example in FIG. 2A. In an alternative embodiment, the upper curb flange is non-coplanar with the lower curb flange, such as shown for example in FIG. 2F, right side. In a particular embodiment, the lower curb flange is approximately perpendicular to the wall brace.

Figure 7B:
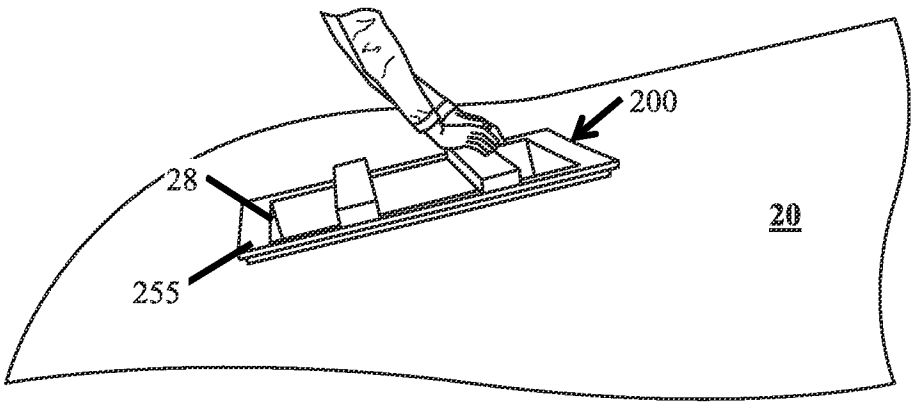
FIGS. 7A and 7B are photographs showing one embodiment of a curb assembly being installed on a tank roof.
Figure 7A:
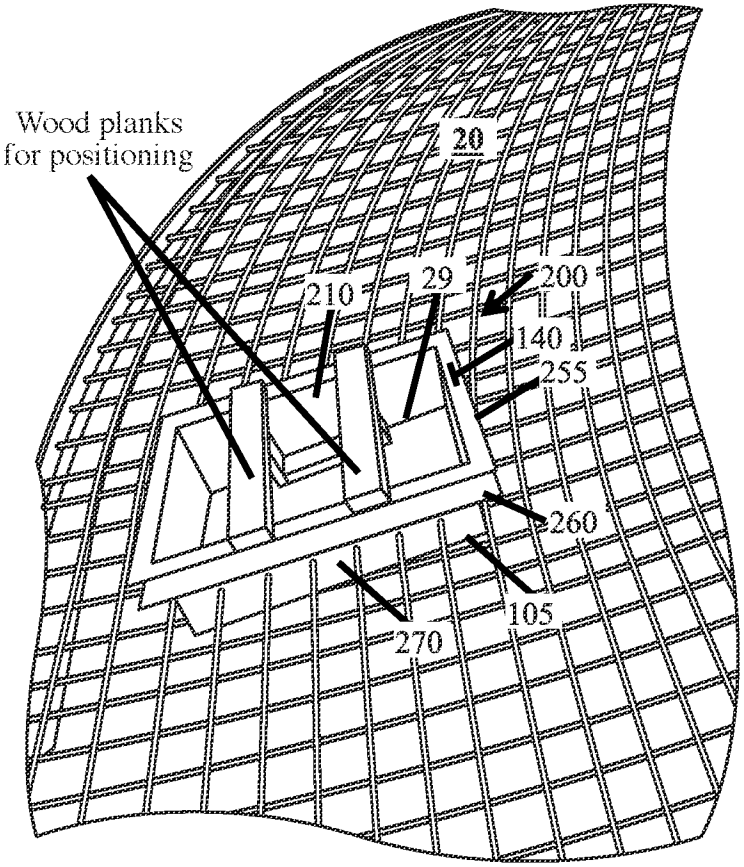

In one embodiment, at least the lower curb flange is incorporated into the structure of a tank 20, such that it is cast, integrated, attached, consolidated, or otherwise incorporated with the tank roof or dome, such as shown, for example in FIGS. 7A and 7B. Such incorporation can position the outer curb within the tank outlet 25. A portion of the wall brace can also be incorporated with the tank structure. Ideally, the upper curb flange extends above the tank inlet sufficiently so that the overflow cover can be installed thereon, as described above. The inner curb 205, which can be attached to the outer curb, can provide additional support for an overflow cover and/or the outer curb, as described above. In one embodiment, the inner curb is attached to the outer curb and incorporated into the tank structure with the outer curb. This is also demonstrated in FIGS. 7A and 7B. In a further embodiment, the inner curb and outer curb are used as a mold around which the tank material can be formed, so as to create a tank outlet in the tank roof 20. This provides the advantage of adjusting the angle and position of the inner curb and outer curb prior to incorporation into the tank, so that the overflow cover is at the proper angle when installed thereon. In an alternative embodiment, the inner curb can be attached to the outer curb after it has incorporated into the tank material. With this method, the tank outlet can be molded by other means and the inner curb can be attached to the other means and/or to the outer curb after the tank outlet is formed.

Overflow from a tank can initially pass through the overflow channel in the curb assembly to the conduit 108 in the overflow cover 100. The advantageous modularity of embodiments of an overflow spout 50 allows, but does not require, the outer curb 250 to be installed separately from the inner curb and the overflow cover 100. Furthermore, the overflow cover and inner curb can be removed and/or replaced without disturbing or removing the lower curb flange or the tank structure. Alternatively, the inner curb and outer curb can be joined and the entire curb assembly can be integrated or incorporated with the tank outlet. With this method of installation, the overflow cover 100 can also be removed without disturbing or removing the inner curb or the curb assembly.

Figure 2B:
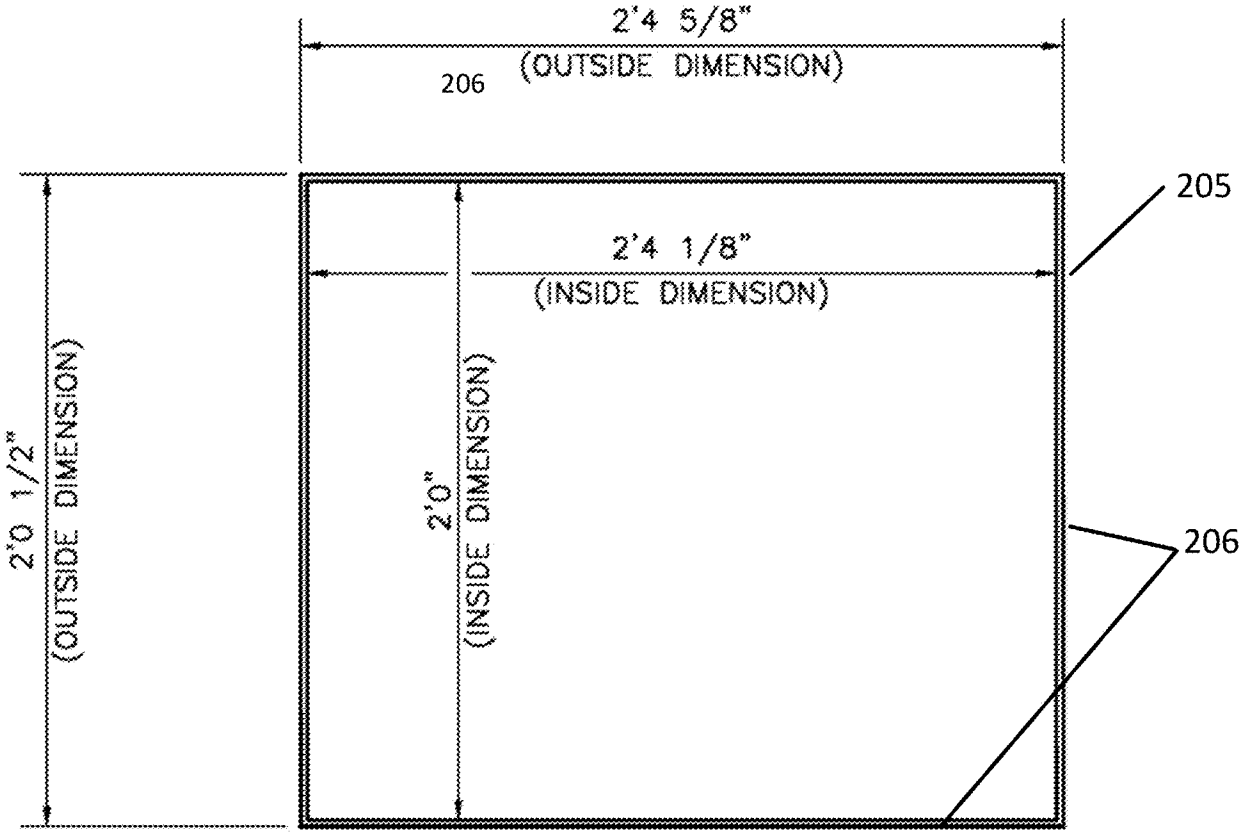
Figure 2C:
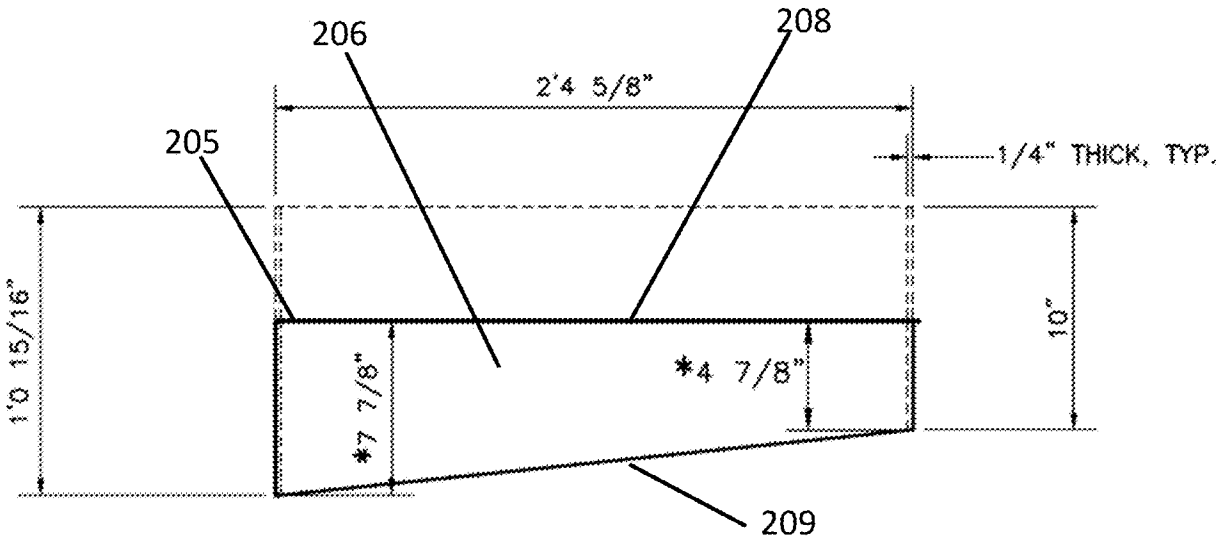
Figure 2D:
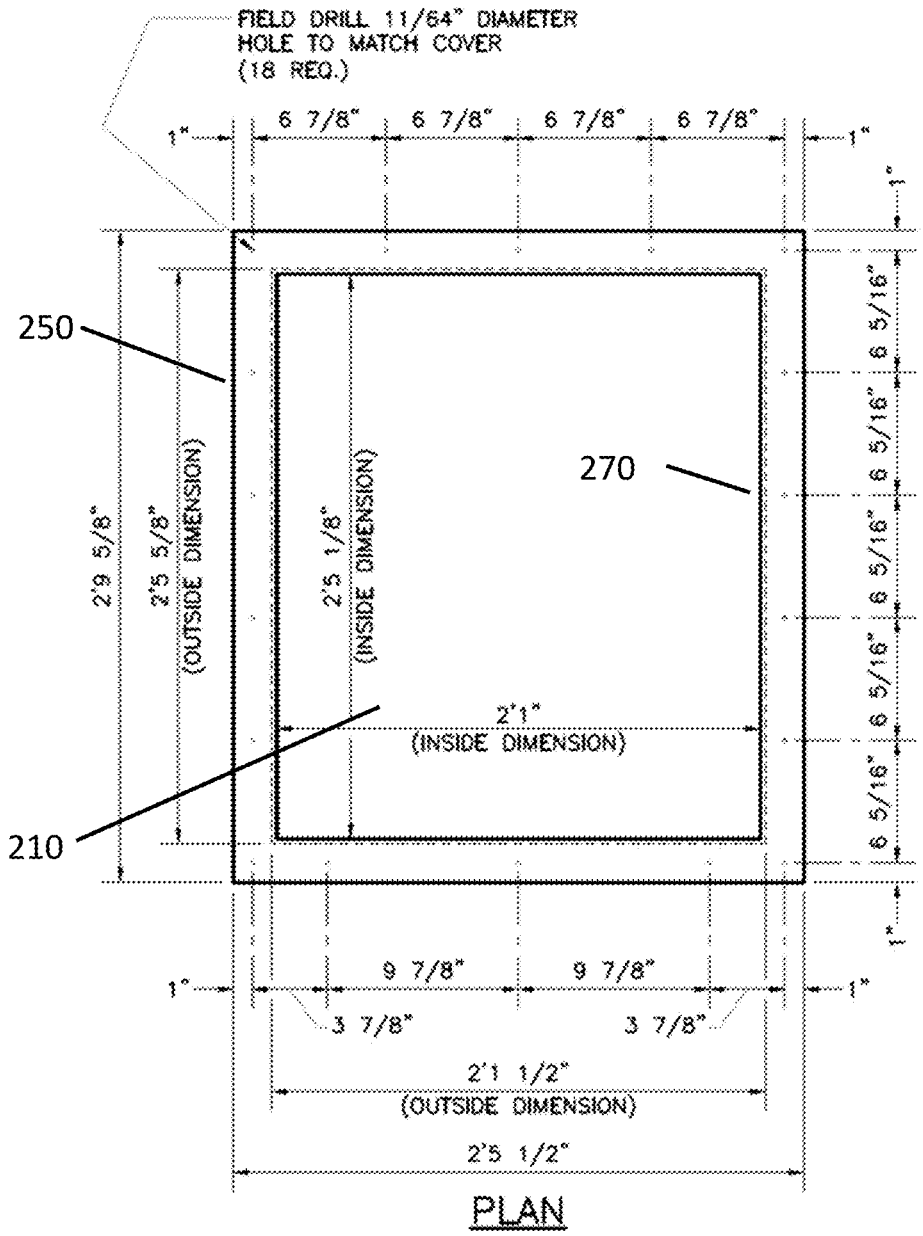
Figure 2E:
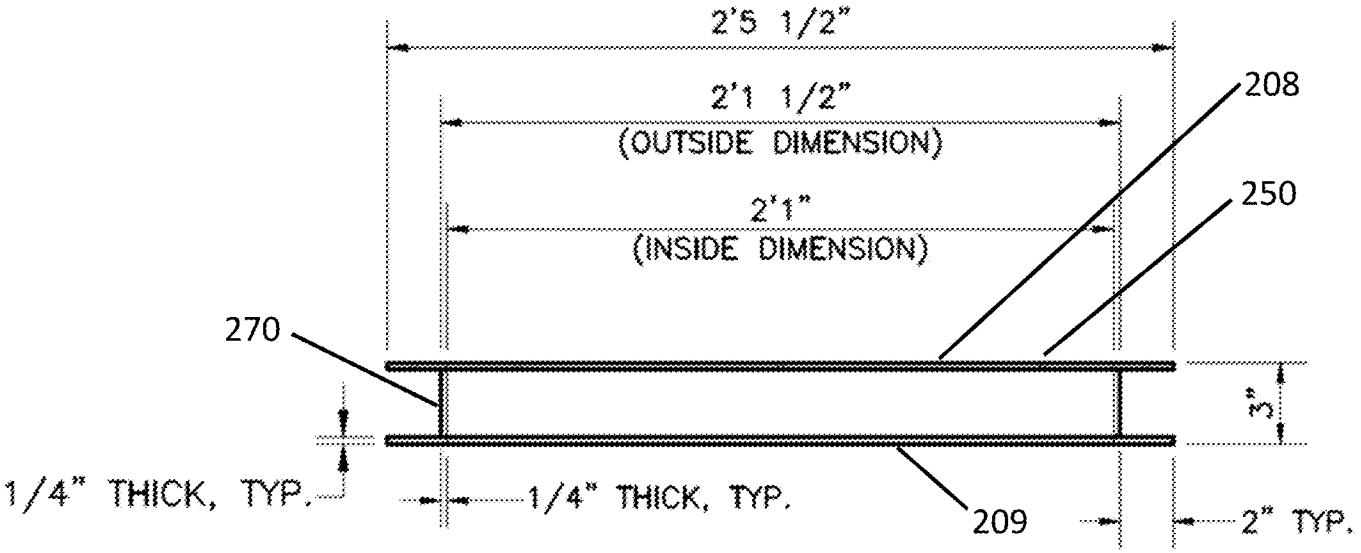
Figure 3:
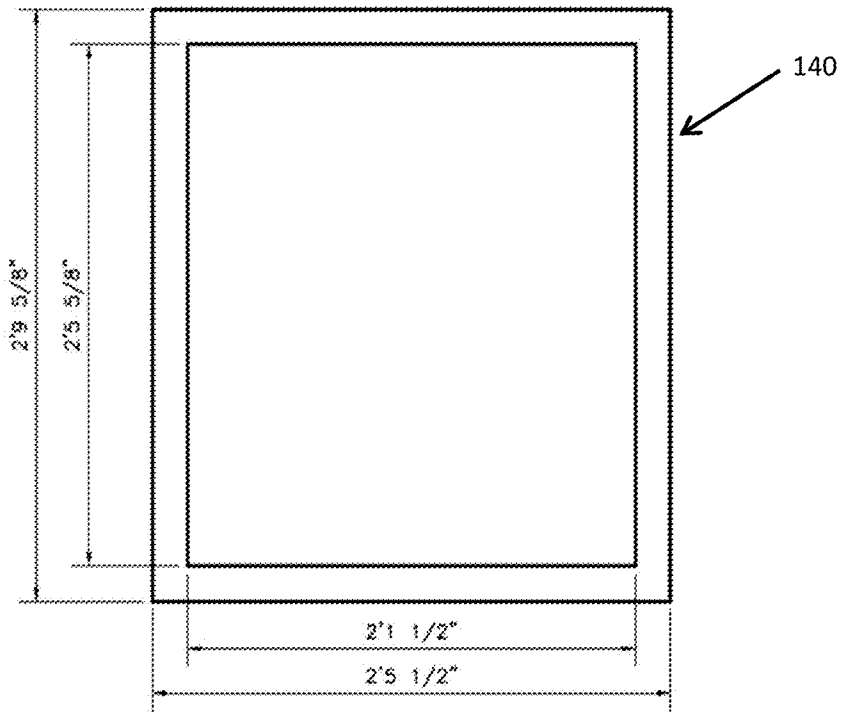
FIG. 3 illustrates one embodiment of a gasket that can be utilized with embodiments of the subject invention.

An inner curb 205 can comprise one or more walls that can be operably connected to an outer curb 250. The one or more walls can define the overflow channel 210 through the inner curb. FIGS. 2B and 2C show one non-limiting example of an inner curb. In one embodiment, the inner curb is positioned within the outer curb, which may or may not have been previously positioned, incorporated, or integrated with the tank outlet. In a further embodiment, the inner curb is removably affixed to the outer curb. In an alternative embodiment, the outer curb is attached to the inner curb. The assembled and joined inner and outer curbs are then placed and installed into the tank roof. This ensures that at least a portion of the inner curb is integrated with the tank outlet, such that both are permanently installed and only the overflow cover can be removed. In one embodiment, the one or more walls of the inner curb extend below the outer curb, such as shown, for example, in FIG. 2A. For example, a portion of the one or more walls of the inner curb that extend below the outer curb can be incorporated with or is at least in contact with the tank inlet, such as shown in FIG. 1B. In a particular embodiment, the inner curb defines the overflow channel and tank outlet.

Figure 2F:
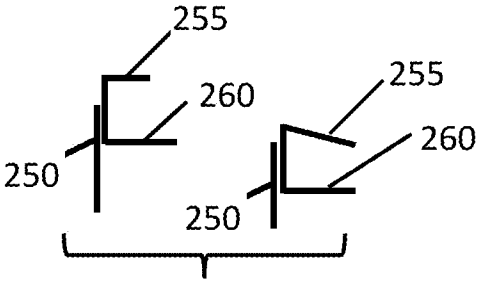

Many large tanks have curved or domed roofs, which can cause the tank outlet 25 to also be angled or tilted on the roof. Ideally, an overflow spout can be positioned or oriented based on the angle or curvature of the domed roof. In one embodiment, the orientation of the outer curb 250 can be adjusted relative to the tank outlet and/or the tank edge or spring line 27 when incorporated into the tank, so that the upper end and the upper curb flange 255 will be at an angle conducive for the support, attachment, and orientation of the overflow cover. Likewise, the inner curb can be affixed to the outer curb in a manner conducive to the support, attachment, and orientation of the overflow cover. In one embodiment, the top of the inner curb 205 is at the same height or is level with the top of the outer curb 250, one example of which is shown in FIGS. 1D and 2A. In an alternative embodiment, the upper end of the inner curb is at a different height and is not level with the upper end of the wall brace 270, examples of which are shown in FIG. 2F. FIG. 1B illustrates an example of an inner curb 205 and outer curb 250 that have been adjusted relative to a tank spring line 27 so that the overflow cover is supported on the curb assembly at the desired angle. In another embodiment, the upper curb flange is above the tank roof, at least sufficient to facilitate attachment of the overflow cover 100.

The bottom end of the inner curb 205 can extend further than the bottom of the outer curb. In a further embodiment, the bottom end of the one or more walls 206 of the inner curb 205 are configured to be complimentary with the angle, curvature, or other shape of the roof interior, such that the bottom end of the one or more walls of the inner curb is parallel to or level with the interior edge 29 of the tank outlet. FIG. 1B illustrates a non-limiting example of an inner curb with walls that do not extend beyond the tank outlet.

Figure 4A:
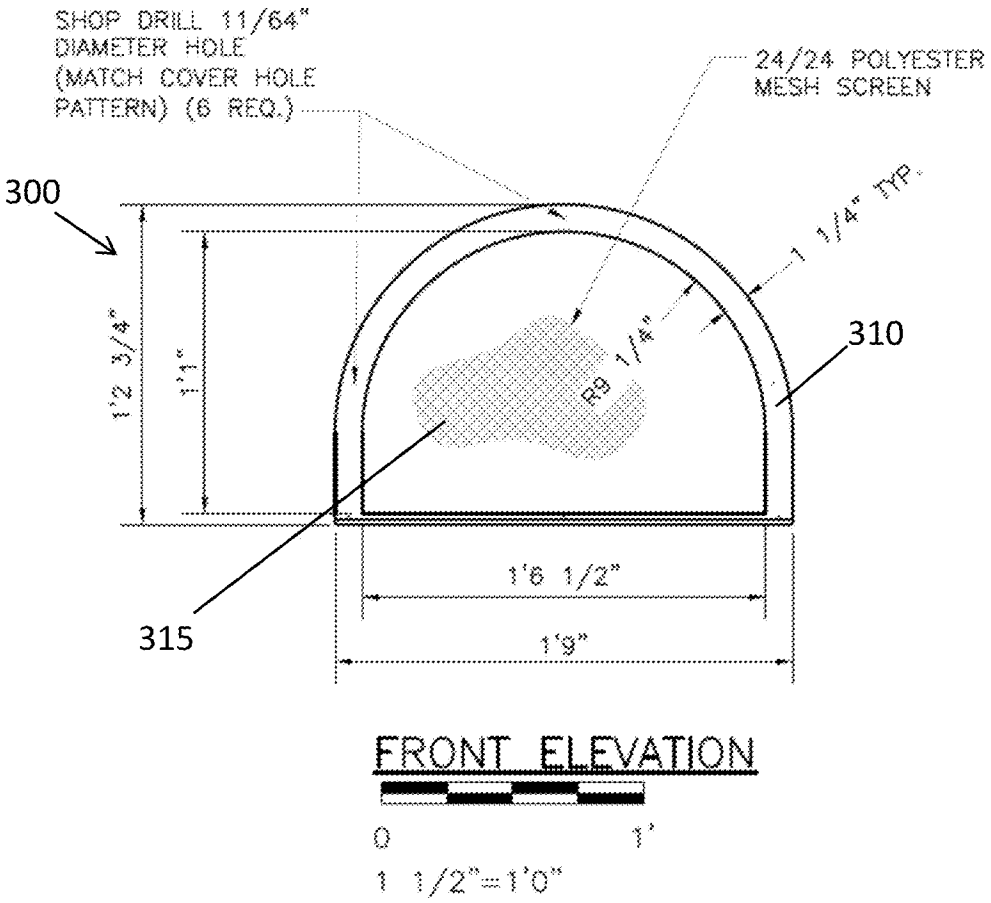
FIGS. 4A and 4B illustrate one embodiment of a protective cover, according to the subject invention. In this embodiment, the protective cover is a framed screen that can be affixed within the exterior opening of the overflow cover.
Figure 4B:
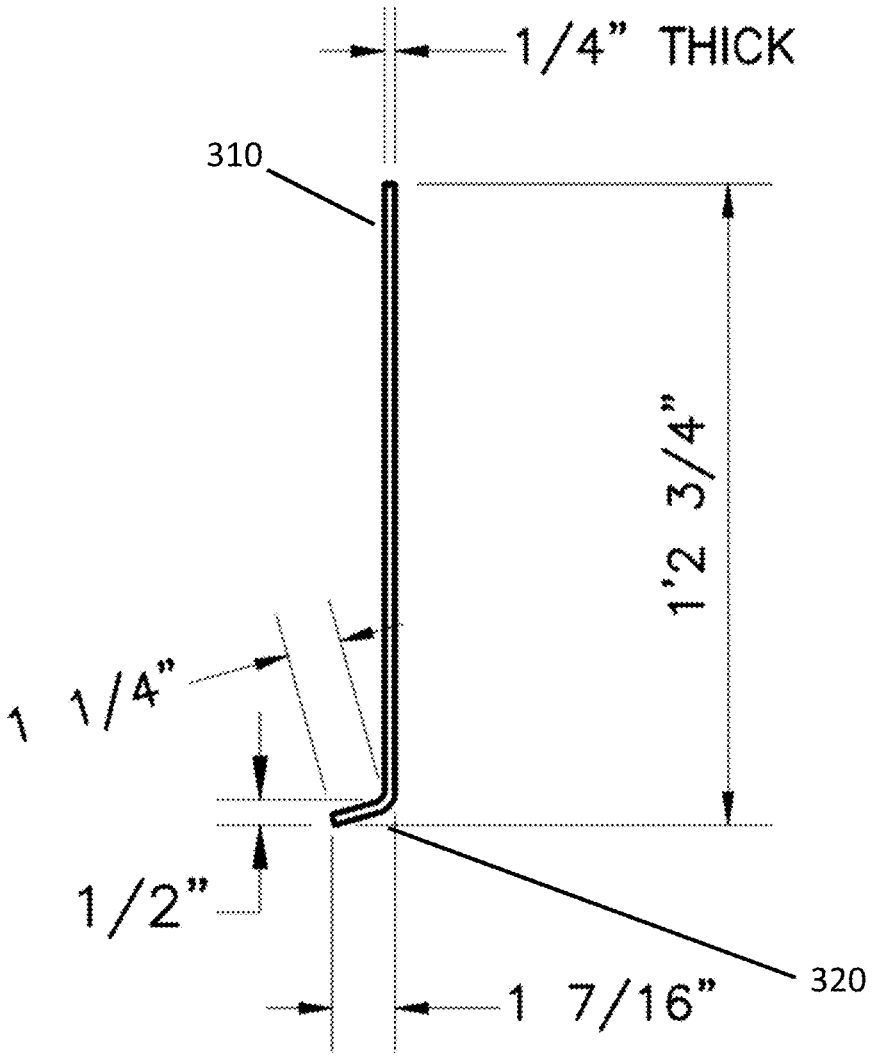

To inhibit debris, animals, insects, and other material from entering a tank through the outlet spout 50, a protective barrier 300 can be placed over the overflow cover exterior opening 110. In one embodiment, a protective cover is a screen that is cooperatively engaged with the exterior opening. In one embodiment, the screen has a frame 310 in which a screen or mesh 315 is secured to allow passage of water and gases. The frame can be mechanically secured so as to cover the exterior opening. In a further embodiment, the exterior opening comprises a bumper 115 against which the frame is removably attached. The bumper can be located anywhere on or within the exterior opening. In one embodiment, the bumper is arranged within the exterior opening such that the protective cover, when attached, does not extend past the outer edge 117 of exterior opening. The protective cover can be mechanically attached to the bumper. The bottom of the frame 310 can rest on or about the weir edge of the tank outlet or the overflow cover. To facilitate the movement of water over the weir edge 112, the bottom of the frame be configured with a curved or bent footer 320 that is directed into the exterior opening 110 and at least partially overlaps and/or abuts the weir edge. Water passing over the footer can exert a downward force that inhibits the protective cover from being pushed out of the exterior opening. FIG. 4B illustrates one example of a footer on a protective cover.

Installation of a modular overflow spout 50 initially comprises placement of the inner curb 205 by incorporation or integration into the tank roof. Next, the outer curb 250 is operably attached and placed simultaneously for incorporation or integration into the tank roof. During initial placement, the position or orientation of both inner and outer curbs, relative to the tank spring line 27, can be adjusted so that the overflow cover is operably connected to the upper curb flange 255 with the weir edge 112 about 3 inches above the top of the wall (T.O.W.). Adjustment of the lower curb flange can also ensure that the overflow cover is positioned at the correct angle or orientation when the cover plate 120 is attached to the upper curb flange 255. For example, it can be beneficial for the exterior opening 110 to be at about a substantially vertical orientation relative to the weir edge of the tank outlet 28. Alternatively, the inner curb can be operatively connected to the outer curb after the outer curb is incorporated into the tank roof.

The modularity of an overflow spout provides the advantage of installing the components thereof separately. The modularity also provides the advantage of utilizing any of a variety of one or more materials for the components. Typical overflow spouts on tanks are cast from concrete as a monolithic structure. According to the embodiments of the subject invention, the components of an overflow spout can advantageously be cast and installed separately. It can also be more advantageous for an overflow spout to be manufactured from lighter materials for easier installation. For example, the components of an overflow spout can be formed from fiberglass, plastic, nylon, wood, ceramics, metals, or any other material with sufficient strength and durability. In one embodiment, the components of an overflow spout are manufactured from the same material. In a specific embodiment, the components of an overflow spout are manufactured from fiberglass with a gelcoat finish. In an alternative embodiment, one or more components are manufactured from a different material than one or more other components. For example, an outer curb can be manufactured from Ultra High Performance Concrete (UHPC) or other concrete material that can be incorporated into the tank structure. Other components can be manufactured from fiberglass or any other material suitable for connection to the UHPC outer curb. In a further embodiment, one or more gaskets or other protective material or object is positioned between components of different materials to facilitate adjoining and operable connection thereof.

Municipal tanks require overflow outlets for release of liquid, such as water, when they become overfull. Overflow spouts are used to cover and protect these overflow outlets to inhibit dirt, animals, insects, and other debris from entering the tank. The embodiments of the subject invention provide unique and advantageous modular overflow spouts with components that can be installed separately. The inner curb, combined with the outer curb with an outer curb flange provides the ability to adjust the position and angle of the overflow spout for maximum efficiency. Other components can then be placed on the outer curb in the correct orientation. Should components need to be repaired or replaced, they can be removed from the outer curb without disturbing the tank structure.

The examples and embodiments described herein are for illustrative purposes only and that various modifications or changes in light thereof will be suggested to persons skilled in the art and are to be included within the spirit and purview of this application.

We claim:

1. A modular overflow spout, configured to cover a tank outlet, comprising:

an overflow cover with a canopy having a bottom tank side opening and exterior opening joined by a conduit;

a cover plate attached and extending from the canopy at or about the tank side opening;

a curb assembly, to which the overflow cover is removably attached, having, an outer curb comprising, at least one wall brace having a upper opening and a bottom opening joined by an overflow channel;

a lower curb flange attached at or about the bottom of the wall brace around the bottom opening, an upper curb flange, attached at or about the top of the wall brace around the upper opening, which attaches to the cover plate; and an inner curb comprising at least one wall with a top and a bottom that is attachable to the wall brace within the tank outlet, such that, when the overflow cover is removably attached to the curb assembly, there is a path between the tank outlet and the exterior opening.

2. The modular overflow spout, according to claim 1, further comprising a rim on the cover plate.

3. The modular overflow spout, according to claim 1, further comprising a weir edge in the exterior opening of the overflow cover.

4. The modular overflow spout, according to claim 1, further comprising the lower curb flange and the upper curb flange being coplanar.

5. The modular overflow spout, according to claim 1, further comprising the lower curb flange that is non-planar with the upper curb flange.

6. The modular overflow spout, according to claim 1, further comprising the lower curb flange and the upper curb flange having different widths.

7. The modular overflow spout, according to claim 1, further comprising at least a portion of the at least one wall of the inner curb that is incorporated with the tank structure.

8. The modular overflow spout, according to claim 1, further comprising:

a bumper within the exterior opening of the overflow cover, and a protective cover operably connected to the bumper.

9. The modular overflow spout, according to claim 8, wherein the protective cover is a framed screen.

10. A method for installing an overflow spout, according to claim 1, in a tank outlet comprising:

connecting the inner curb to the outer curb such that the inner curb is within the tank outlet;

positioning the outer curb in the tank outlet, with the lower curb flange incorporated with the tank outlet and the upper curb flange above the tank outlet;

connecting the cover plate of the overflow cover to the upper curb flange, such that the overflow cover is above the tank outlet and the conduit and overflow channel are continuous with the tank outlet.

11. The method, according to claim 10, further comprising adjusting the lower curb flange in the tank outlet, relative to the tank spring line, to orient the upper curb flange at an angle conducive for attachment of the cover plate on the overflow cover.

12. The method, according to claim 10, further comprising connecting the inner curb to the outer curb prior to the outer curb being incorporated with the tank outlet.

13. The method, according to claim 11, wherein at least a portion of the inner curb is incorporated with the tank outlet.

14. The method, according to claim 11, further comprising positioning a gasket between the upper curb flange and the cover plate.

15. The method, according to claim 11, comprising a weir edge on the overflow cover and the method comprises positioning the overflow cover with the weir edge about 3 inches above the top of the wall of the tank.

* * * * *